US009466950B2

(12) United States Patent
Delchambre et al.

(10) Patent No.: US 9,466,950 B2
(45) Date of Patent: Oct. 11, 2016

(54) CO-AXIAL COMMUTATION SPARK GAP

(71) Applicant: ENE29 S.ar.l., Luxembourg (LU)

(72) Inventors: Michael Delchambre, Toulouse (FR); Salvador Moncho, Malakoff (FR)

(73) Assignee: ENE29 S.AR.L., Luxembourg (LU)

( * ) Notice: Subject to any disclaimer, the term of this patent is extended or adjusted under 35 U.S.C. 154(b) by 0 days.

(21) Appl. No.: 14/650,098

(22) PCT Filed: Dec. 5, 2013

(86) PCT No.: PCT/EP2013/075701

§ 371 (c)(1),
(2) Date: Jun. 5, 2015

(87) PCT Pub. No.: WO2014/086939

PCT Pub. Date: Jun. 12, 2014

(65) Prior Publication Data

US 2015/0349497 A1 Dec. 3, 2015

(30) Foreign Application Priority Data

Dec. 7, 2012 (FR) ..... 12 61756

(51) Int. Cl.

| | |
|---|---|
| ***H01T 1/22*** | (2006.01) |
| ***H01T 1/20*** | (2006.01) |
| ***H01T 2/02*** | (2006.01) |
| ***H01T 13/20*** | (2006.01) |
| ***H01T 4/12*** | (2006.01) |
| *H01T 4/10* | (2006.01) |
| *H01T 4/04* | (2006.01) |

(52) U.S. Cl.
CPC . *H01T 1/22* (2013.01); *H01T 2/02* (2013.01); *H01T 4/12* (2013.01); *H01T 4/04* (2013.01)

(58) Field of Classification Search
CPC ..... H01T 1/22; H01T 1/20; H01T 2/02; H01T 2/00; H01T 4/12; H01T 4/10; H01T 13/00; H01T 13/20
USPC ..... 315/39
See application file for complete search history.

(56) References Cited

U.S. PATENT DOCUMENTS 2,817,036 A * 12/1957 Neal ..... H01T 2/02 313/146
3,087,091 A 4/1963 Mcfarland
4,410,495 A 10/1983 Bassler et al.

(Continued)

FOREIGN PATENT DOCUMENTS

DE 30 05 040 A1 7/1981
EP 1 629 577 B1 3/2006

OTHER PUBLICATIONS

International Search Report, dated Feb. 2, 2014, from corresponding PCT application.

*Primary Examiner* — Dylan White
(74) *Attorney, Agent, or Firm* — Young & Thompson

(57) ABSTRACT

A commutation spark gap includes at least one first electrode and one second electrode, both electrically conducting, each including an arc zone placed opposite the arc zone of the other electrode, the electrodes being adapted to be linked to the terminals of a source of potential. The spark gap exhibits a general tubular shape, the first electrode forming a cylindrical body of the spark gap, open at its two ends, and the second electrode, termed the central electrode, cylindrical and co-axial with the first, extending along the axis of the spark gap at least from one end to the other of the cylindrical body.

20 Claims, 1 Drawing Sheet

(56) References Cited

U.S. PATENT DOCUMENTS 7,626,468 B2 * 12/2009 Staines ..... H03B 11/00 331/126
7,741,783 B2 * 6/2010 Stark ..... F41H 13/0068 315/39.51
2003/0076044 A1 * 4/2003 Staines ..... F41H 13/0068 315/39
2007/0058319 A1 * 3/2007 Frescaline ..... H01T 2/02 361/139
2008/0122363 A1 * 5/2008 Stark ..... F41H 13/0093 315/39.51

* cited by examiner

CO-AXIAL COMMUTATION SPARK GAP

BACKGROUND OF THE INVENTION

1. Field of the Invention

The invention concerns a switching spark gap that is capable of transferring, in a fraction of a second, a current of very high intensity under very high voltage between its electrodes, and more particularly such a spark gap having two coaxial electrodes traversing the spark gap from end to end.

2. Description of the Related Art

Switching spark gaps are generally employed in applications such as the Marx generator or another very-high-voltage assembly, for example in combination with capacitors enabling electrical energy to be stored and to be restored in the form of a current of very high intensity under very high voltage.

From document EP 1 629 577, for example, such a spark gap is known having two elongated electrodes facing each other, between which an electric arc develops, the triggering of the electric arc being capable of being effected by the exceeding of a threshold of voltage between the electrodes or by the application of a voltage to a triggering electrode.

However, it has been observed that in applications such as the Marx generator many spark gaps have to be combined with many capacitors, for example in parallel connection, and that great complexity of wiring results from this, in particular in order to take the anode of the spark gap to the anode of the adjacent capacitors.

Furthermore, spark gaps such as the one mentioned above have a complex internal organization on account of the third, triggering electrode. When they are used with a triggering by exceeding of a threshold for self-ignition of the spark gap, they are difficult to adjust.

SUMMARY OF THE INVENTION

The present invention aims to provide a switching spark gap that is simple to implement.

The invention also aims to provide such a spark gap that is easy to combine with capacitors connected in parallel.

The invention aims, in addition, to provide such a spark gap in which the wear of the electrodes is minimized.

The invention aims furthermore to provide such a spark gap, the space requirement of which is reduced for the same switching power.

In order to do this, the invention concerns a switching spark gap having at least a first electrode and a second electrode, both electrically conductive, each having an arcing zone placed opposite the arcing zone of the other electrode, the electrodes being suitable to be connected up to the terminals of a source of potential, characterized in that the spark gap exhibits a tubular general shape, said first electrode forming a cylindrical body of the spark gap, open at its two ends, and said second electrode, called the central electrode, which is cylindrical and coaxial with the first, exhibiting an electrical continuity over its whole length and extending within the axis of the spark gap at least from one end of the cylindrical body to the other.

Owing to this cylindrical shape with the central electrode, it is possible to gain access to the two electrodes at each end of the spark gap. Moreover, by using capacitors of similar form—that is to say, having a central anode and an external cathode—it becomes very easy to realize an assembly in which the switching spark gap and the capacitors are in parallel by simple interlocking.

Throughout the present description it is assumed that the spark gap is linked up in such a way that the positive pole of the voltage generator feeding the assembly is connected to the central electrode of the spark gap, and this electrode, as well as its connected elements, is referred to by the term 'anode' or 'anodic'. In contrast, the cylindrical body of the spark gap is connected to the negative pole of the voltage generator, and this electrode, as well as its connected elements, is referred to by the term 'cathode' or 'cathodic'. Of course, this does not prejudge the actual linking-up of the spark gap, the poles of the latter being capable of being reversed without thereby departing from the invention.

Advantageously and according to the invention, the central electrode is kept at a distance from the body of the spark gap by at least one sleeve having an insulator traversed by the central electrode. In this way, a sleeve with an outside diameter substantially equal to the inside diameter of the body enables an insulator made of dielectric material, itself traversed by the central electrode, to be centered in relation to said body. Other sleeves may be provided, depending on the length of the central electrode, in order to keep the latter coaxial with the body.

Advantageously and according to the invention, at least one of said sleeves is movable in relation to the body of the spark gap along the axis of the latter. The displacement of the sleeve enables, if need be, the central electrode to be displaced along the axis of the spark gap.

Advantageously and according to the invention, one of said sleeves has a fitting electrically connected up to the body of the spark gap in order to form the arcing zone of the body. By joining a fitting, for example made of material such as an alloy of copper and tungsten, onto one of the sleeves in electrical contact with the body of the spark gap, an arcing zone is obtained in which the electric arc may form while minimizing the erosion of the electrode.

Advantageously and according to the invention, the central electrode has a fitting that is suitable to form the arcing zone of the central electrode. Likewise, a fitting made of an alloy of copper and tungsten can be mounted on the central electrode, opposite the fitting connected to the body, in order to form the arcing zone of the central electrode.

Advantageously and according to the invention, the arcing zones are surfaces of revolution which are coaxial with one another and have an axis coincident with the axis of the spark gap. In this way, an electric arc forming between the arcing zones exhibits a substantially radial direction in relation to the axis of the spark gap, and the magnetic field associated with the arcing current drives said arc in a rotational movement about the axis of the spark gap, thereby avoiding a premature wear of a particular point of the arcing zone.

Advantageously and according to the invention, the shape of the arcing zones is suitable so that an air gap between the arcing zones is variable, according to the respective position of each movable sleeve. By matching the respective fittings of the central electrode and of the sleeve connected to the body so that they exhibit coaxial, substantially cylindrical shapes with opposite rounded edges spaced apart from one another, the air gap provided between these edges exhibits a minimum value when these edges are in the same transverse plane, and increases when the axial distance between the planes of each edge increases.

Advantageously and according to the invention, the spark gap has two sleeves defining between them a space, called the firing space, within which the arcing zones of the two electrodes are located. In this preferred embodiment, the central electrode is held by two placed sleeves substantially at each end of the cylindrical body. The fitting forming the arcing zone of the central electrode is placed between the two sleeves, and one of the two sleeves bears the fitting connected to the body of the spark gap, opposite the fitting of the central electrode. In this way, any electric arc triggered between the two arcing zones of the respective fittings of the central electrode and of the body is confined within the space delimited by the two sleeves.

Advantageously and according to the invention, the sleeves are provided with sealing means enabling the firing space to be filled with a gas under pressure. By placing O-rings, for example, between the outer face of the sleeves and the inner face of the cylinder of the body of the spark gap, bushings stuck around the rods forming the central electrode, etc., a sealed zone is delimited between the two sleeves, which it is possible to fill with an inert gas having a high dielectric constant, said gas being suitable for the stabilization of an electric arc, such as, for example, sulfur hexafluoride or dry air under pressure.

Adjustment of the gas pressure inside the sealed zone allows also the fine tuning of the triggering threshold of the spark gap.

Advantageously and according to the invention, the central electrode is mounted so as to be fixed in relation to one of the sleeves and slidable in relation to the other. In order to enable a wide range of adjustment of the air gap, the two sleeves are slidable in relation to the body of the spark gap. One of the sleeves bears the fitting in contact with the body of the spark gap, and the central electrode is mounted so as to be fixed in relation to the other sleeve. In this way, by displacing each of the two sleeves it is possible to influence the spacing of the air gap while minimizing the displacement of the ends of the central electrode.

Adjustment of the spacing of the air gap allows also to adjust the ignition voltage of the spark gap.

Advantageously and according to the invention, the ends of the central electrode are provided with connecting means that are suitable to cooperate with conjugate connecting means borne by other coaxial components. By providing a bushing at one of the ends of the central electrode and a pin at the other end, it is possible to connect, for example, one or more capacitors exhibiting a similar coaxial shape, likewise provided each with a pin or with a bushing, according to the end to which they have to be connected.

The invention also concerns a switching spark gap, characterized in combination by all or some of the features mentioned above or below.

BRIEF DESCRIPTION OF THE DRAWING FIGURES

Other objects, features and advantages of the invention will become apparent from the following description and from the appended drawings, in which.

DETAILED DESCRIPTION OF THE INVENTION

Figure 1:
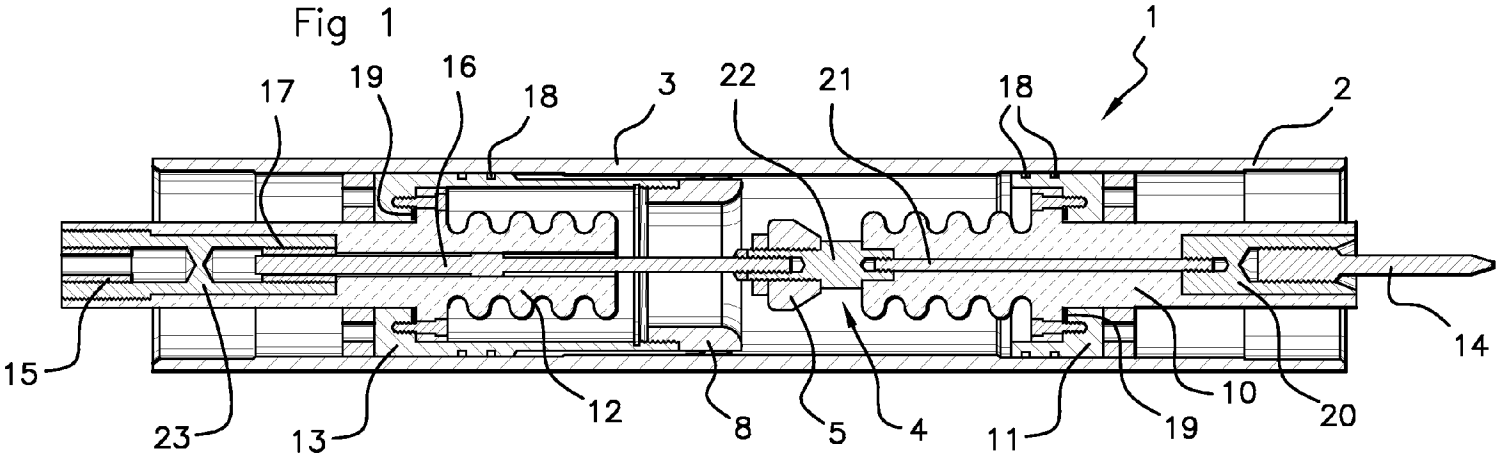
FIG. 1 is a sectional view of a spark gap according to the invention.

FIG. 1 represents a sectional view of the spark gap 1 according to the invention. The spark gap 1 has a first electrode 2 forming a cylindrical body 3 made of conductive material. The choice of the material depends on the conditions of use of the spark gap 1, and it may be left to the assessment of a person skilled in the art to choose amongst most of the metals, such as copper, aluminum, steel (stainless or not), possibly coated with protective layers (nickel, etc.).

A second electrode or central electrode 4 extends coaxially and in the center of the body 3. The central electrode 4 includes, starting from the right in FIG. 1, a connecting pin 14 which is screwed or force-fitted within a cylindrical connecting piece 20 inserted into an insulator 10, for example made of ceramic, glass, resin or any other material exhibiting suitable dielectric characteristics. The insulator 10 exhibits a substantially cylindrical shape, having on its outer face a series of radial undulations enabling the electrical pathway to be increased, as known in the technology of insulators. The insulator 10 is traversed by a rod 21 which is screwed, on the one hand, into the connecting piece 20 and, on the other hand, into a cylindrical electrode support 22. The connecting piece 20 has a seal at the interface with the insulator 10, so as to realize a sealed feed-through of said insulator.

The electrode support 22 bears a fitting 5 having the shape, at least in part, of a cylinder of revolution. Fitting 5 is made of a material that is particularly suitable to withstand electric arcs, for example an alloy of copper and tungsten.

A second conductive rod 16 traverses a second insulator 12, of a shape similar to that of insulator 10, and connects up the electrode support 22 to a contact bushing 17 which is screwed or force-fitted within a second cylindrical connecting piece 23 inserted in sealed manner at the end of insulator 12. The second connecting piece 23 also has a bore, within which a connecting bushing 15 is fixed. The inside diameter of the connecting bushing 15 is suitable to cooperate with the outside diameter of a connecting pin similar to the pin 14, so as to realize a connection by interlocking with a coaxial capacitor (not represented) having such a pin.

The rod 16 is slidably mounted within insulator 12 and within the contact bushing 17 so as to enable a relative longitudinal movement between insulator 10, within which the central electrode 4 is mounted so as to be fixed, and insulator 12. This sliding mounting also enables the two insulators to be decoupled in rotation.

In this way the central electrode 4 exhibits an electrical continuity from the connecting bushing 15 at one of the ends of the cylindrical body 3 right up to the connecting pin 14 at the other end.

Insulator 10 is fixed to a sleeve 11 which keeps it in a coaxial position centered in relation to the cylindrical body 3. Sleeve 11 is suitable to be movable in relation to the body 3, for example by means of an external thread cooperating with a corresponding thread inside the body 3. Seals 18 between the body 3 and sleeve 11, and a seal 19 between insulator 10 and sleeve 11, enable an impervious barrier to be realized within the body 3. Similarly, insulator 12 is mounted on a sleeve 13 that is suitable to be movable in relation to the body 3 and to form an impervious barrier on either side of sleeve 13. In this way, the two sleeves and their respective insulators determine between themselves a sealed space, called the firing space 24, within which the fitting 5 of the central electrode 4 is located. The sleeves 11 and 13 are preferably metallic, and therefore electrically conductive, for reasons of mechanical strength, but may be provided in any other material, conductive or not, exhibiting an appropriate mechanical strength.

Sleeve 13 has, in addition, a cylindrical extension parallel to the body 3, extending within the firing space 24 in the direction of sleeve 11. A fitting 8, made of a material similar to that of fitting 5, and of substantially cylindrical shape, is fixed to the end of this extension of sleeve 13. This fitting 8 is in electrical contact with the body 3, on the one hand through the agency of sleeve 13 if the latter is metallic, but also by virtue of contact tabs 9 fixed to fitting 8 and rubbing on the inside of the body 3, thereby realizing an electrical continuity having lower resistance and better reliability.

Figure 2:
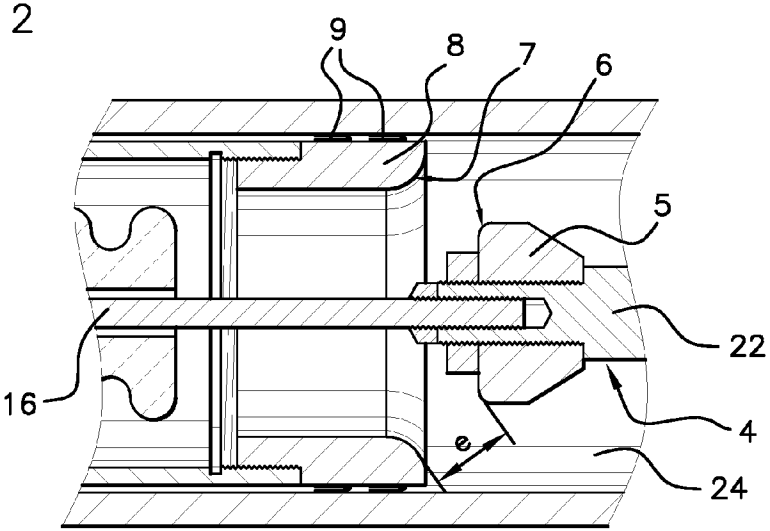
FIG. 2 represents a detail of the firing space of a spark gap according to the invention.

Reference is made to FIG. 2, which represents a detailed view of a portion of the firing space 24, within which are shown fittings 5 and 8 respectively connected up to the central electrode 4 and to the body 3.

The outer surface of fitting 5 is placed opposite the inner surface of fitting 8 and outside the latter. The rounded portion of the outer surface of fitting 5 located at the intersection between its face orthogonal to the axis of the spark gap and its cylindrical periphery is the part of the central electrode 4 closest to fitting 8 and in this way forms an arcing zone 6 of the central electrode 4. Likewise, the rounded part of the surface of fitting 8 opposite the arcing zone 6 of the central electrode 4 forms the arcing zone 7 of the body 3. The minimum distance between the arcing zones 6 and 7 forms an air gap e. The arcing zones 6 and 7 are surfaces of revolution, coaxial with each other, and have an axis coincident with that of the spark gap, and therefore the air gap e is constant, whatever the radial direction being considered.

The length of this air gap, the pressure and the nature of the gas occupying the firing space 24 determine the ignition voltage of the spark gap. When the voltage at the terminals of the spark gap—that is to say, between the body 3 and the central electrode 4—exceeds this ignition voltage, an electric arc forms between the arcing zones and transfers an electric charge accumulated in one or more charging devices such as capacitors (not represented) connected in parallel with the spark gap. In a manner known as such, the air gap e being constant whatever the radial direction, the point of ignition of the arc is random on the perimeter of the arcing zones, and the magnetic field generated by the electric arc forces the latter to circulate around the axis of the spark gap. In this way, the wear of the fittings is homogeneous and reduced.

The ignition voltage of the spark gap according to the invention is advantageously adjustable by influencing the length of the air gap e, for example by longitudinally displacing one or the other of the two sleeves along the axis of the spark gap. The two sleeves will preferably be displaced concomitantly, in order to minimize the displacement of the pin 14 and of the connecting bushing 15.

The connection of the body 3 of the spark gap with the body of charging devices mounted coaxially with the spark gap 1 may be realized by any means known to a person skilled in the art, for example by flanges, bushings, etc.

Of course, this description is given solely by way of illustrative example, and a person skilled in the art will be able to make numerous modifications thereto without departing from the scope of the invention, such as, for example, providing the body 3 with a valve for pressurizing the firing space, or providing a pressurizing channel within the central electrode.

The invention claimed is:

1. A switching spark gap comprising:

at least a first electrode and a second electrode, both electrically conductive, each electrode having an arcing zone placed opposite the arcing zone of the other electrode, the electrodes being adapted to be connected up to the terminals of a source of potential, the spark gap exhibiting a tubular general shape, said first electrode forming a cylindrical body of the spark gap, open at two ends, wherein said second electrode, named the central electrode, is cylindrical and coaxial with the first, said second electrode exhibiting an electrical continuity over an entire length and extending within an axis of the spark gap at least from one end of the cylindrical body to the other and is held at a distance from the cylindrical body of the spark gap by at least one sleeve having an insulator traversed by the central electrode.

2. The spark gap as claimed in claim 1, wherein at least one of said sleeves is movable in relation to the body of the spark gap along the axis thereof.

3. The spark gap as claimed in claim 2, wherein a shape of arcing zones is suitable so that an air gap between arcing zones is variable, according to the respective position of each movable sleeve.

4. The spark gap as claimed in claim 2, wherein one of said sleeves has a fitting electrically connected up to the body of the spark gap in order to form the arcing zone of the body.

5. The spark gap as claimed in claim 2, wherein the central electrode has a fitting that is adapted to form an arcing zone of the central electrode.

6. The spark gap as claimed in claim 2, wherein arcing zones are surfaces of revolution coaxial with each other and having an axis coincident with the axis of the spark gap.

7. The spark gap as claimed in claim 2, having two sleeves defining between themselves a space, called the firing space, within which arcing zones of the two electrodes are located.

8. The spark gap as claimed in claim 1, wherein one of said sleeves has a fitting electrically connected up to the body of the spark gap in order to form an arcing zone of the body.

9. The spark gap as claimed in claim 8, wherein the central electrode has a fitting that is adapted to form an arcing zone of the central electrode.

10. The spark gap as claimed in claim 8, wherein the arcing zones are surfaces of revolution coaxial with each other and having an axis coincident with the axis of the spark gap.

11. The spark gap as claimed in claim 8, wherein there are two arcing zones and a shape of the arcing zones is adapted so that an air gap between the arcing zones is variable, according to the respective position of each movable sleeve.

12. The spark gap as claimed in claim 1, wherein the central electrode has a fitting that is adapted to form an arcing zone of the central electrode.

13. The spark gap as claimed in claim 12, wherein the arcing zones are surfaces of revolution coaxial with each other and having an axis coincident with the axis of the spark gap.

14. The spark gap as claimed in claim 12, wherein there are two arcing zones and a shape of the arcing zones is suitable so that an air gap between the arcing zones is variable, according to the respective position of each movable sleeve.

15. The spark gap as claimed in claim 1, wherein arcing zones are surfaces of revolution coaxial with each other and having an axis coincident with the axis of the spark gap.

16. The spark gap as claimed in claim 15, wherein a shape of the arcing zones is adapted so that an air gap between the arcing zones is variable, according to the respective position of each movable sleeve.

17. The spark gap as claimed in claim 1, having two sleeves defining between themselves a space, called the firing space, within which arcing zones of the two electrodes are located.

18. The spark gap as claimed in claim 17, wherein the sleeves are provided with sealing means enabling the firing space to be filled with a gas under pressure.

19. The spark gap as claimed in claim 17, wherein the central electrode is mounted so as to be fixed in relation to one of the sleeves and slidable in relation to the other.

20. The spark gap as claimed in claim 1, wherein the ends of the central electrode are provided with connecting means that are suitable to cooperate with conjugate connecting means borne by other coaxial components.

* * * * *